US006384585B2

(12) United States Patent
Cusinato et al.

(10) Patent No.: US 6,384,585 B2
(45) Date of Patent: May 7, 2002

(54) CURRENT GENERATOR FOR ALTERNATIVELY PROVIDING A FIRST CONSTANT CURRENT AND A RATIOED SECOND CONSTANT CURRENT TO A SIGMA-DELTA MODULATOR

(75) Inventors: Paolo Cusinato, Sestri Levante; Andrea Baschirotto, Tortona; Vittorio Colonna, Landriano; Gabriele Gandolfi, Siziano, all of (IT)

(73) Assignee: STMicroelectronics, S.R.L., Agrate Brianza (IT)

( * ) Notice: Subject to any disclaimer, the term of this patent is extended or adjusted under 35 U.S.C. 154(b) by 0 days.

(21) Appl. No.: 09/853,402

(22) Filed: May 11, 2001

(30) Foreign Application Priority Data

May 16, 2000 (IT) ..... MI2000A001071

(51) Int. Cl.[7] ..... G05F 3/04; G05F 3/16
(52) U.S. Cl. ..... 323/312; 323/314; 323/315
(58) Field of Search ..... 323/312, 314, 323/315

(56) References Cited

U.S. PATENT DOCUMENTS 4,988,954 A * 1/1991 Stern et al. ..... 330/264
5,049,653 A * 9/1991 Smith et al. ..... 330/267

* cited by examiner

*Primary Examiner*—Bao Q. Vu
(74) *Attorney, Agent, or Firm*—Hogan & Hartson, LLP

(57) ABSTRACT

The present invention refers to a current generator able to provide in alternative to a first terminal a first current and a second current in response to a control signal. Particularly it refers to a current generator usable for the adaptive biasing of modulators of the sigma-delta type.

In an embodiment the current generator is able to provide in alternative to a first terminal (70) a first current and a second current in response to a control signal (CK), characterized by comprising: a first current generator (40) able to provide said first current; a second current generator (41) able to provide said second current; commutation means (46) able to connect in alternative to said first terminal (70) said first current and said second current in response to said control signal (CK).

20 Claims, 3 Drawing Sheets

CURRENT GENERATOR FOR ALTERNATIVELY PROVIDING A FIRST CONSTANT CURRENT AND A RATIOED SECOND CONSTANT CURRENT TO A SIGMA-DELTA MODULATOR

DESCRIPTION

The present invention refers to a current generator able to provide in alternative to a first terminal a first current and a second current in response to a control signal. Particularly it refers to a current generator usable for the adaptive biasing of modulators of the sigma-delta type. It refers besides to a modulator of the sigma-delta type having an adaptive current generator.

To elaborate an analogical signal by means of digital circuits it is necessary to use a converter to convert the analogical signal into a digital signal. The modern technology requires fast and accurate conversion circuits. Lately the modulators of the sigma-delta type, which constitute a large part of the converters, have been much used thanks to their excellent performances.

The sigma-delta modulators comprise, as basic elements, some operational amplifiers which are normally of the AB class. In the case in which the pass band of the operational amplifiers is very wide the power consumption gets up fearfully, adaptive bias circuits able to reduce such consumption have therefore been studied.

The operational amplifiers of a sigma-delta modulator have an operation divided in two steps. A first step of sampling signal in which the requirements in terms of band are not elevated and it is therefore possible to have a reduced current consumption. Besides in this step in which the greatest worry is that the operational amplifier is stable, by reducing the current consumption it is possible to get also an increase of the phase margin. A second step in which the signal is integrated, in this case the maximum width of the available band is necessary and consequently it is not possible to limit the current consumption.

There are therefore known circuits that provide a feeding to these operational amplifiers according to the two above steps and that is an elevated current during the integration step and a reduced current during the sampling step. Such circuits are based mainly on the fact of having two current generators, one directly connected to the operational amplifier and the other connectable on order. Such circuits are however usable only for relatively low working frequency. As the working frequencies increase more elevated current and very fast response time are necessary, and the circuits based on the preceding type circuits are not able to get such performances.

In view of the state of the art described, it is an object of the present invention to provide a current generator usable for the adaptive biasing in modulators of the sigma-delta type suitable for elevated frequencies and without the drawbacks of the known art.

According to the present invention, such object and others are achieved by means of a current generator able to provide in alternative to a first terminal a first current and a second current in response to a control signal, characterized by comprising: a first current generator able to provide said first current; a second current generator able to provide said second current; commutation means able to connect in alternative to said first terminal said first current and said second current in response to said control signal.

According to the present invention, such objects are also reached by means of a sigma-delta modulator comprising at least an operational amplifier able to work alternatively as an integrator and as a sampler and having a first bias current and a second bias current, characterized by comprising a current generator, according to claim 1, able to provide in alternative to a supply terminal of said operational amplifier said first current and said second current in response to a control signal.

The features and the advantages of the present invention will be made more evident by the following detailed description of a particular embodiment, illustrated as a non-limiting example in the annexed drawings, wherein.

Figure 1:
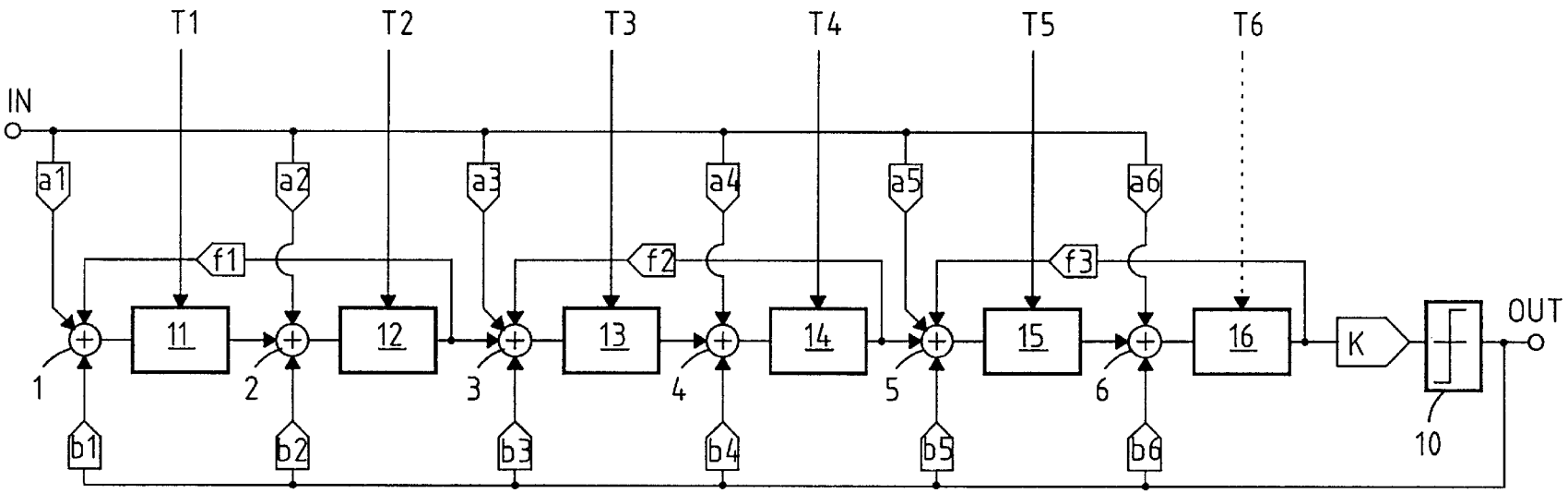
FIG. 1 shows a block scheme of a sigma-delta modulator.

In FIG. 1 it is represented an embodiment of a sigma-delta modulator of the sixth order able to work at a sampling frequency of 42.8 MHz, according to the present invention. The modulator has an input In and an output OUT. The signal present at the input In is applied to the input of the blocks related to the direct coefficients a1–a6 which in turn are connected to the adder nodes 1–6. To the adder nodes 1–6 are also connected the outputs of the blocks related to the inverse coefficients b1–b6 to the inputs of which the signal coming from the output OUT is applied. The outputs of the adder nodes are applied respectively to the operational amplifiers 11–16. To each adder node 1–6 the output of the previous operational amplifier is also applied. To the adder nodes 1, 3 and 5 are also applied, respectively, the outputs of the blocks related to the feedback coefficients f1–f3 of the operational amplifiers 12, 14 and 16. To the output signal of the operational amplifier 16 is applied a corrective factor k and then it is applied to a threshold circuit 10, in turn connected to the output OUT.

To the operational amplifiers 11–16 are connected respectively the feeding terminals T1–T6.

The operational amplifiers 11–16, which, in the example here described, must have a pass band greater than 400 MHz, consume 80 mW by means of an adaptive feeding current according to the present invention, with respect to about 120 mW when continually fed with the same current, besides the characteristics in terms of dynamic range (equal to about 73 dB), SFDR (equal to about 77 dB) and SNR (equal to about 60 dB) do not change with respect to the case of continuous feeding. Besides a profit of the phase margin equal to about 20° is obtainable. In a modulator of the sixth order three operational amplifiers, for instance 11, 13 and 15, are in the sampling step and three operational amplifiers, for instance 12, 14 and 16 are in the integration step and vice versa.

Figure 2:
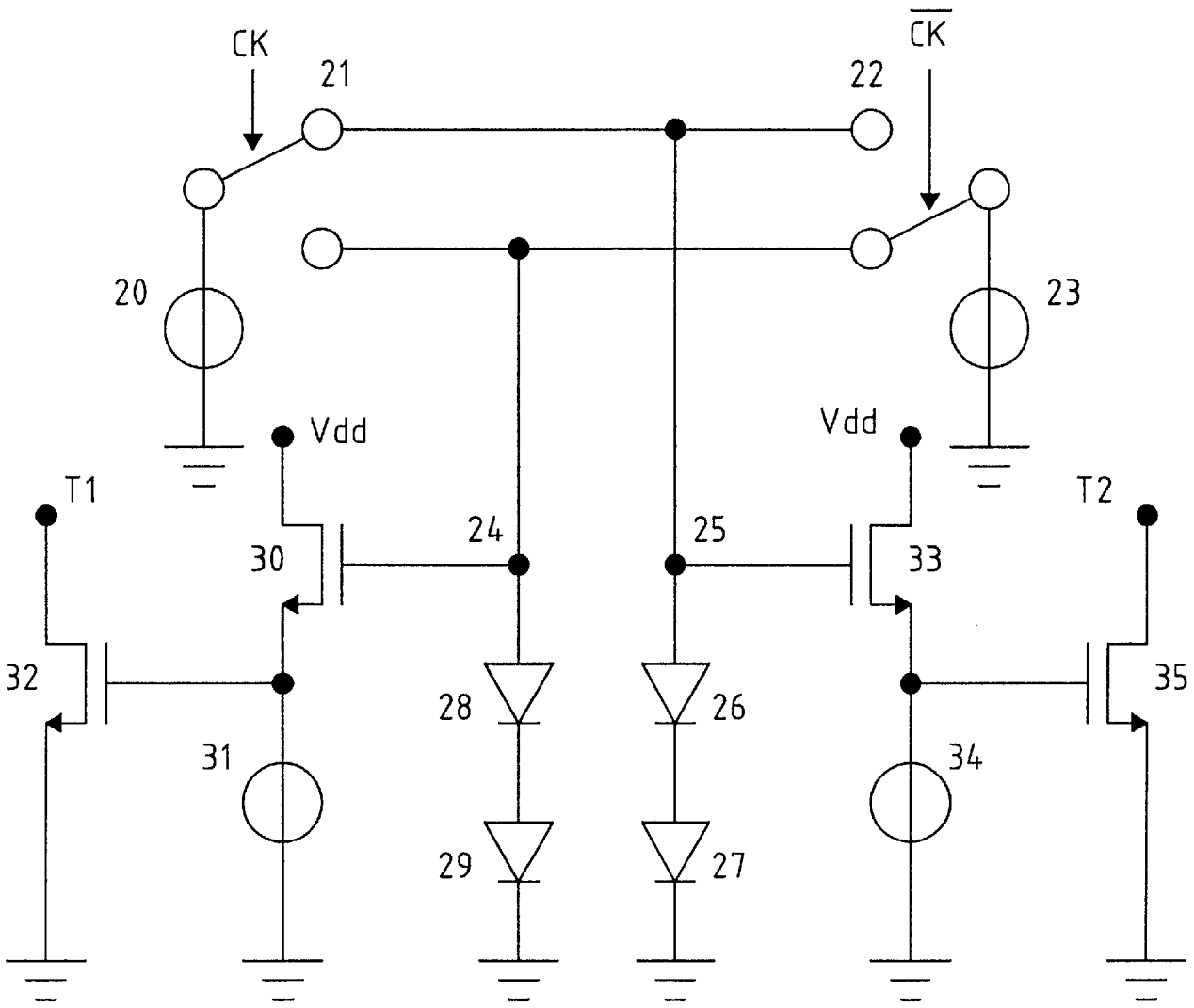
FIG. 2 shows a simplified circuit scheme of a current generator according to the present invention.

In FIG. 2 is shown a simplified circuit scheme of a current generator according to the present invention, able to provide two different current in response to a control signal, so as to reduce the power consumption of the sampling step.

In FIG. 2, for simplicity of representation, it is reported a circuit scheme able to provide current to only two operational amplifiers.

It comprises a current generator 20, able to provide a current for instance equal to Ib, a current generator 23, able to provide a current for instance equal to Ib/4. The selector switch 21, connected to the current generator 20, is able to selectively connect, in response to a control signal CK, the generator 20 either on a terminal 24 or on a terminal 25. Similarly, on the other symmetrical branch of the circuit, the selector switch 22, connected to the current generator 23, is able to selectively connect, in response to an inverted control signal CK, the generator 23 either to a terminal 24 or to a terminal 25. Respectively between the terminals 24 and 25 and ground, two diodes 28, 29 and 26, 27 are connected so as to be set in conduction by the current generators 20 and 23. The voltage across the two diodes is taken and it is respectively applied to the gate of a first and of a second transistor 30 and 33 with n channel, which have the drain connected to the supply voltage Vdd and the source connected respectively to a fixed current generator 31, equal to Ib, and to a fixed current generator 34, equal to Ib. The source are also connected respectively to the transistors 32 and 35 with n channel having the source connected to ground and the drain able to provide the supply current to the operational amplifiers, for instance 11 and 12, through the terminals T1 and T2.

The control signal CK, and its inverted CK, are square wave signals having a frequency equal to about 42.8 MHz and they are applied to the selector switches 21 and 22 which allow to connect the generators 20 and 23 once to the terminal 24 and once to the terminal 25 so that in the diodes 28, 29 and 26, 27, in alternative, either the current of the generator 20 and equal to Ib or the current of the generator 23 and equal to Ib/4 is flowing. The different current present on the diodes 28, 29 and 26, 27 will cause a different voltage on the terminals 24 and 25, greater on the terminal where the higher current (Ib) flows. The transistors 30 and 33 work as voltage followers with constant current and respectively equal to that of the generators 31 and 34 and equal to Ib. The voltage present on the terminals 24 and 25 are so reported, reduced by the voltage drop Vgs of the transistors 30 and 33, on the gate of the transistors 32 and 35 which will provide respectively to the terminals T1 and T2 the current respectively flowing in the diodes 28, 29 and 26, 27.

Figure 3:
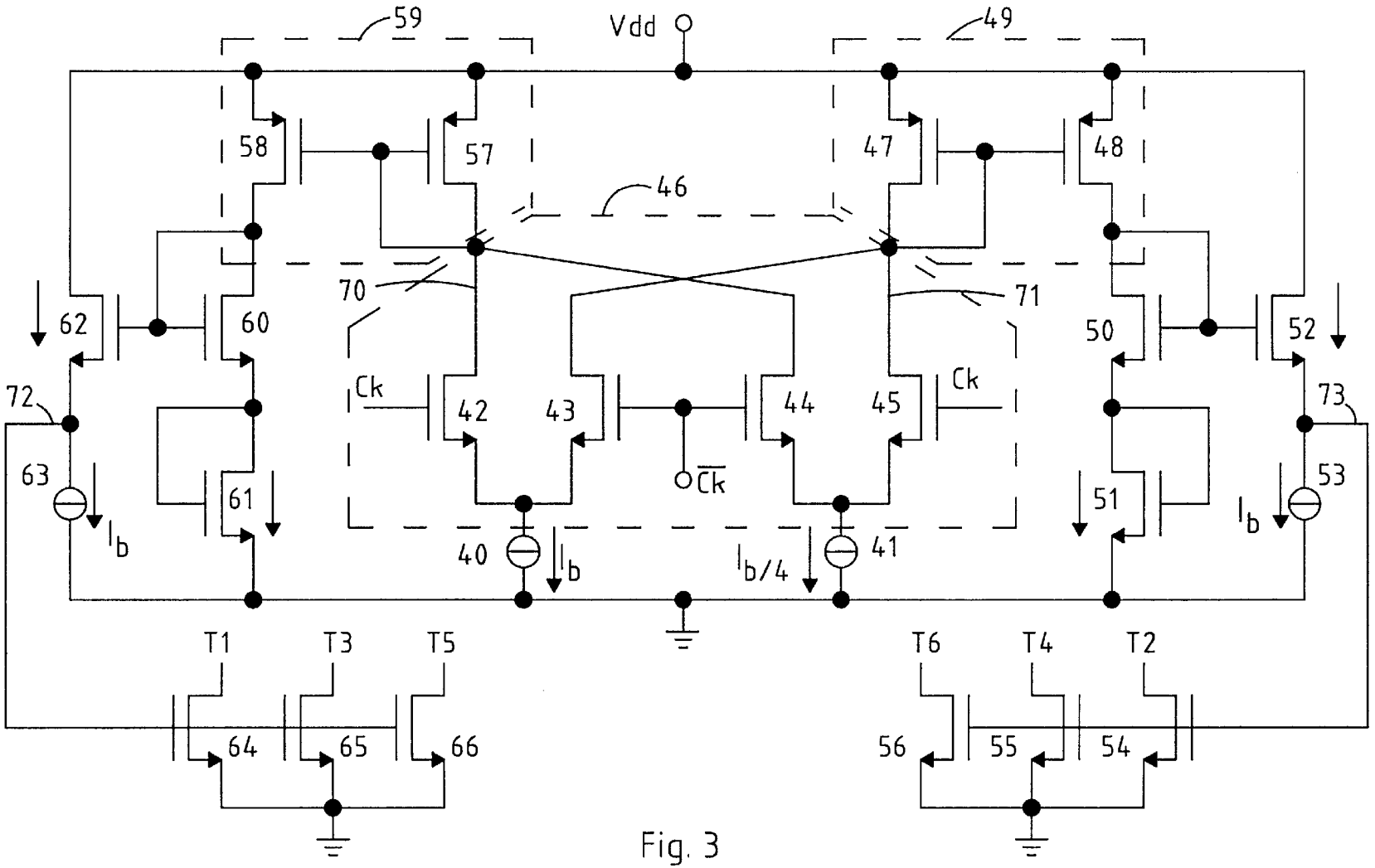
FIG. 3 shows a detailed circuit scheme of a current generator according to the present invention.

In FIG. 3 a detailed circuit scheme of a current generator according to the present invention is shown.

It comprises a current generator 40, able to provide a current for instance equal to Ib, a current generator 41, able to provide a current for instance equal to Ib/4. The two generators 40 and 41 are applied to two differential couples 46. The first couple of the two differential couples 46 comprises two transistors 42 and 43 with n channels having the source connected together and connected to the generator 40, the two gates connected respectively to a control signal CK and inverted CK, the two drains connected respectively to two terminals 70 and 71. The second couple of the two differential couples 46 comprises two transistors 44 and 45 with n channels having the source connected together and connected to the generator 41, the two gates connected respectively to a control signal of inverted CK and CK, the two drains connected respectively to two terminals 70 and 71.

To the terminal 70 is connected a first branch of a current mirror 59 including the transistors 57 with p channel connected as a diode, and 58 with p channel.

To the terminal 71 is connected a first branch of a current mirror 49 including the transistors 47 with p channel connected as a diode, and 48 with p channel.

To the second branch of the mirror 59 and particularly to the transistor 58 are applied two transistors 60 and 61 with n channels connected as a diode, and connected in series, able to be directly biased by the current flowing in the transistor 58. The voltage present in the connection point of the transistors 58 and 60 is applied to the gate of a transistor 62 with n channels having the drain connected to the supply voltage and the source connected to a fixed current generator 63 for instance equal to Ib. The voltage present on the terminal 72, and that is in the connection point of the transistor 62 and of the generator 63, is applied to the gate of the transistors 64–66 which have the source connected to ground and the drain connected respectively to the terminals T1, T3 and T5. Analogously for the other part of the circuit that is symmetrical we have that to the second branch of the mirror 49 and particularly to the transistor 48 are applied two transistors 50 and 51 with n channels connected as a diode, and connected in series, able to be directly biased from the current flowing in the transistor 48. The voltage present in the point of connection of the transistors 48 and 50 is applied to the gate of a transistor 52 with n channels having the drain connected to the supply voltage and the source connected to a fixed current generator 53 for instance equal to Ib. The voltage present on the terminal 73, and that is in the point of connection of the transistor 52 and of the generator 53, is applied to the gate of the transistors 54–56 which have the source connected to ground and the drain connected respectively to the terminals T2, T4 and T6.

The operation is analogous to that of FIG. 2 apart from greater circuit complexity, particularly due to the presence of the differential couple 46 that works like commutation means likewise to the selector switches 21 and 22 and to the presence of the two current mirrors 49 and 59.

Obviously the current generator according to the present invention could be used also to supply a single circuit that requires a first current and a second current in response to a control signal.

What is claimed is:

1. Current generator able to provide in alternative to a first terminal (70) a first current and a second current in response to a control signal (CK), characterized by comprising:

a first constant current generator (40) able to provide said first current;

a second constant current generator (41) able to provide said second current as a fixed ratio of said first current; and commutation means (46) able to connect in alternative to said first terminal (70) said first current and said second current in response to said control signal (CK).

2. Current generator according to claim 1 characterized by comprising a second terminal (71) and said commutation means (46) are able to connect in alternative to said first terminal (70) and to said second terminal (71) respectively said first current and said second current and to said first terminal (70) and to said second terminal (71) respectively said second current and said first current in response to said control signal (CK).

3. Current generator according to claim 1 characterized in that said first current is greater than said second current.

4. Current generator according to claim 1 characterized in that said control signal (CK) consists of a digital signal of prefixed frequency.

5. Current generator according to claim 2 characterized in that said commutation means (46) comprises a first and a second differential couple (42, 43, 44, 45);

said first differential couple (42, 43) comprises a first transistor (42) and a second transistor (43) having both the source terminals connected to said first current generator (40), the gate connected respectively to said control signal (CK) and to said inverted control signal (CK), the drain connected respectively to said first terminal (70) and to said second terminal (71);

said second differential couple (44, 45) comprises a third transistor (44) and a fourth transistor (45) having both the source terminals connected to said second current generator (41), the gate connected respectively to said inverted control signal (CK) and to said control signal (CK), the drain connected respectively to said first terminal (70) and to said second terminal (71).

6. Current generator according to claim 5 characterized by comprising a first current mirror (59) having a branch joined to said first terminal (70), a first output stage (60, 61, 62, 63) joined to a branch of said first current mirror (59) and a first transistor (62) connected to a third terminal (72) and to a first fixed current generator (63);

a third mirror of current (49) having a branch joined to said second terminal (71), a second output stage (50, 51, 52, 53) joined to a branch of said third current mirror (49) and a second transistor (52) connected to a fourth terminal (73) and to a second fixed current generator (53).

7. Current generator according to claim 6 characterized in that to said third (72) and fourth terminal (73) are connected respectively a first plurality of transistors (64–66) and a second plurality of transistors (54–56).

8. Current generator according to claim 1 characterized by comprising two diodes (28, 29) connected in series connected between said first terminal (24) and ground, a first transistor (30) having the gate connected to said first terminal (24), the drain connected to a supply voltage (Vdd), the source connected to a first fixed current generator (31).

9. Sigma-delta modulator comprising at least an operational amplifier (11–16) able to work alternatively as an integrator and as a sampler and having a first bias current and a second bias current, characterized by comprising a current generator, according to claim 1, able to provide in alternative to a supply terminal (T1–T6) of said operational amplifier (11–16) said first current and said second current in response to a control signal (CK).

10. A current generator comprising:

a first constant current;

a second constant current equal to a fixed ratio of the first current;

a cross-coupled transistor circuit for providing the first current to a first terminal and the second current to a second terminal under a first data state of a clock signal, and for providing the first current to the second terminal and the second current to the first terminal under a second data state of the clock signal;

a first current mirror having an input coupled to the first terminal, and an output;

a second current mirror having an input coupled to the second terminal, and an output;

a first diode-connected transistor circuit coupled to the output of the first current mirror;

a second diode-connect transistor circuit coupled to the output of the second current mirror;

a first voltage follower circuit having an input coupled to the output of the first current mirror and an output;

a second voltage follower circuit having an input coupled to the output of the second current mirror and an output;

a first output transistor circuit having at least one output and an input coupled to the output of the first voltage follower circuit; and a second output transistor circuit having at least one current output and an input coupled to the output of the second voltage follower circuit.

11. The current generator of claim 10 wherein the fixed ratio is equal to four.

12. The current generator of claim 10 wherein the cross-coupled transistor circuit comprises:

a first differential pair of transistors switched by the clock signal having a coupled source for receiving the first constant current, and having a first drain coupled to the first terminal and a second drain coupled to the second terminal; and a second differential pair of transistors switched by an inverted clock signal having a coupled source for receiving the second constant current, and having a first drain coupled to the first terminal and a second drain coupled to the second terminal.

13. The current generator of claim 10 wherein the first and second current mirrors each comprise a P-channel current mirror.

14. The current generator of claim 10 wherein the first and second diode-connected transistors each comprises a first diode-connected N-channel transistor in series connection with a second diode-connected N-channel transistor.

15. The current generator of claim 10 wherein the first and second voltage follower circuits each comprise an N-channel transistor having a gate forming the input, a drain coupled to a source of supply voltage, and a source coupled to a constant current forming the output.

16. The current generator of claim 10 wherein the first and second output transistor circuits each comprise three output transistors having coupled gates forming the input, sources coupled to ground, a first drain forming a first current output, a second drain forming a second current output, and a third drain forming a third current output.

17. A sigma-delta modulator having increased operating speed and lowered power consumption comprising:

a plurality of operational amplifiers for alternatively providing a sampling and an integrating function; and a single current generator circuit having multiple current outputs for alternatively providing a first constant current to the integrating operational amplifiers and a second constant current to the sampling operational amplifiers, wherein the second constant current is a fixed ratio of the first constant current.

18. The sigma-delta modulator of claim 17 wherein the fixed ratio is equal to four.

19. The sigma-delta modulator of claim 17 wherein the current comprises cross-coupled transistor means controlled by a clock signal for switching the first and second constant currents alternatively between the integrating and sampling operational amplifiers.

20. The sigma-delta modulator of current generator of claim 17 having a pass band greater than 400 MHz and consuming about 80 mW.

* * * * *